US008811118B2

(12) United States Patent
Reckmann

(10) Patent No.: US 8,811,118 B2
(45) Date of Patent: Aug. 19, 2014

(54) DOWNHOLE NOISE CANCELLATION IN MUD-PULSE TELEMETRY

(75) Inventor: Hanno Reckmann, Nienhagen (DE)

(73) Assignee: Baker Hughes Incorporated, Houston, TX (US)

( * ) Notice: Subject to any disclaimer, the term of this patent is extended or adjusted under 35 U.S.C. 154(b) by 1953 days.

(21) Appl. No.: 11/855,686

(22) Filed: Sep. 14, 2007

(65) Prior Publication Data

US 2008/0074948 A1 Mar. 27, 2008

Related U.S. Application Data

(60) Provisional application No. 60/846,659, filed on Sep. 22, 2006.

(51) Int. Cl.

| | |
|---|---|
| ***E21B 47/14*** | (2006.01) |
| ***G01V 1/40*** | (2006.01) |
| ***E21B 47/18*** | (2012.01) |
| ***G01V 3/00*** | (2006.01) |

(52) U.S. Cl.

USPC ..... 367/81; 367/83; 367/84; 367/85; 340/854.3; 340/855.3

(58) Field of Classification Search

CPC ..... G10K 11/178; G10K 11/1784; G10K 11/1788; G10K 2210/00; G10K 2210/3026; G10K 2210/3027; G10K 2210/3045; G10K 2210/504; E21B 47/12; E21B 47/14; E21B 47/18; E21B 47/182; E21B 47/185; E21B 47/187

USPC ..... 340/853.1, 853.3, 853.4, 855.6, 856.4, 340/853.2, 853.9, 854.3, 854.4, 854.5, 340/855.3–855.5; 367/81–83; 381/71.1–71.14

See application file for complete search history.

(56) References Cited

U.S. PATENT DOCUMENTS

| | | | | |
|---|---|---|---|---|
| 3,716,830 | A | 2/1973 | Garcia | 340/18 LD |
| 3,742,443 | A | 6/1973 | Foster et al. | 340/18 LD |
| 3,747,059 | A | 7/1973 | Garcia | 340/18 LD |
| 3,810,113 | A * | 5/1974 | Jordan | 377/44 |
| 4,262,343 | A | 4/1981 | Claycomb | 367/83 |
| 4,590,593 | A | 5/1986 | Rodney | 367/83 |
| 4,642,800 | A | 2/1987 | Umeda | 367/85 |
| 4,692,911 | A | 9/1987 | Scherbatskoy | 367/83 |
| 4,715,022 | A | 12/1987 | Yeo | 367/83 |

(Continued)

FOREIGN PATENT DOCUMENTS

| | | |
|---|---|---|
| EP | 0617196 A2 | 9/1994 |
| GB | 2361789 A | 10/2001 |

(Continued)

*Primary Examiner* — Hai Phan
*Assistant Examiner* — Franklin Balseca
(74) *Attorney, Agent, or Firm* — Mossman Kumar & Tyler PC

(57) ABSTRACT

Pressure measurements are made using a pressure sensor in the proximity of the drillbit during drilling operations. A filtered version of the pressure measurements is provided to a pulser for a mud-pulse telemetry system so as to cancel pressure variations due to drilling noise while a telemetry signal is being sent. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims. 37 CFR 1.72(b).

20 Claims, 6 Drawing Sheets

(56) References Cited

U.S. PATENT DOCUMENTS

| | | | | |
|---|---|---|---|---|
| 4,965,832 | A * | 10/1990 | Edwards et al. | 381/71.5 |
| 5,117,401 | A * | 5/1992 | Feintuch | 367/135 |
| 5,146,433 | A | 9/1992 | Kosmala et al. | 367/83 |
| 5,886,303 | A * | 3/1999 | Rodney | 181/102 |
| 5,969,638 | A | 10/1999 | Chin | 340/855.3 |
| 6,626,253 | B2 | 9/2003 | Hahn et al. | 175/48 |
| 6,891,376 | B2 * | 5/2005 | Hanstein et al. | 324/333 |
| 7,158,446 | B2 * | 1/2007 | Gardner et al. | 367/81 |
| 7,265,682 | B2 * | 9/2007 | Memarzadeh et al. | 340/870.18 |
| 7,313,052 | B2 * | 12/2007 | Fincher et al. | 367/83 |
| 7,453,372 | B2 * | 11/2008 | Hentati et al. | 340/853.2 |
| 7,480,207 | B2 * | 1/2009 | Marsh | 367/83 |
| 2004/0202047 | A1 * | 10/2004 | Fripp et al. | 367/81 |
| 2005/0034917 | A1 * | 2/2005 | Mathiszik et al. | 181/108 |
| 2006/0055556 | A1 | 3/2006 | Memarzadeh et al. | |
| 2007/0017671 | A1 * | 1/2007 | Clark et al. | 166/248 |
| 2010/0284546 | A1 * | 11/2010 | DeBrunner et al. | 381/71.2 |

FOREIGN PATENT DOCUMENTS

| | | | |
|---|---|---|---|
| GB | 2438050 | A | 11/2007 |
| WO | WO0077345 | A1 | 12/2000 |
| WO | WO0146548 | A2 | 6/2001 |
| WO | WO0186325 | A1 | 11/2001 |
| WO | WO2006052319 | A1 | 5/2006 |
| WO | WO2006110391 | A2 | 10/2006 |
| WO | WO2007095153 | A1 | 8/2007 |

* cited by examiner

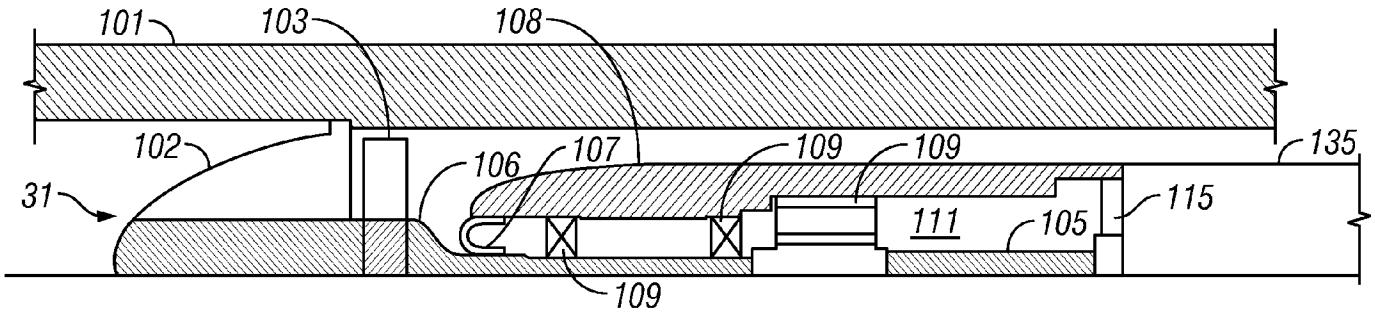
FIG. 2A
(Prior Art)
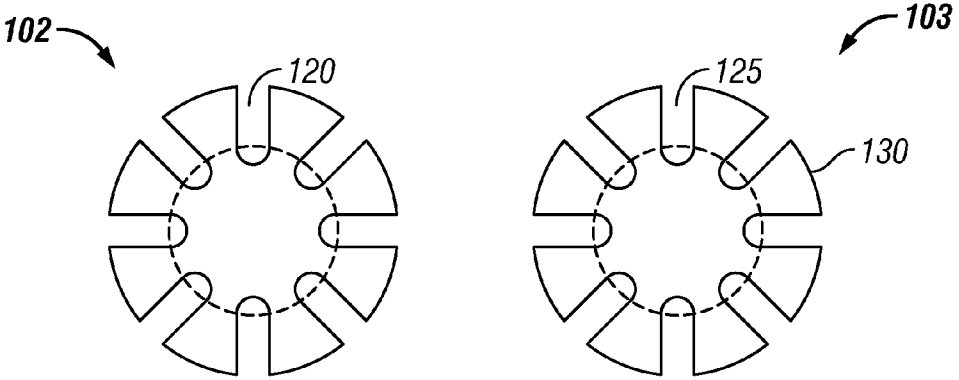
FIG. 2C
(Prior Art)
FIG. 2B
(Prior Art)

DOWNHOLE NOISE CANCELLATION IN MUD-PULSE TELEMETRY

CROSS-REFERENCES TO RELATED APPLICATIONS

This application claims priority from U.S. provisional patent application Ser. No. 60/846,659 filed on Sep. 22, 2006.

BACKGROUND OF THE DISCLOSURE

1. Field of the Disclosure

The present disclosure relates to telemetry systems for communicating information from a downhole location to a surface location, and, more particularly, to a method of removing noise at the downhole location produced by downhole sources.

2. Description of the Related Art

Drilling fluid telemetry systems, generally referred to as mud pulse systems, are particularly adapted for telemetry of information from the bottom of a borehole to the surface of the earth during oil well drilling operations. The information telemetered often includes, but is not limited to, parameters of pressure, temperature, direction and deviation of the well bore. Other parameters include logging data such as resistivity of the various layers, sonic density, porosity, induction, self-potential and pressure gradients. This information is important to efficiency in the drilling operation and is used in reservoir development.

MWD Telemetry is required to link the downhole MWD components to the surface MWD components in real-time, and to handle most drilling related operations without breaking stride. The system to support this is quite complex, with both downhole and surface components that operate in step.

In any telemetry system there is a transmitter and a receiver. In MWD Telemetry the transmitter and receiver technologies are often different if information is being uplinked or down-linked. In up-linking, the transmitter is commonly referred to as the Mud-Pulser (or more simply "the pulser") and is an MWD tool in the BHA that can generate pressure fluctuations in the mud stream. The surface receiver system comprises sensors that measure the pressure fluctuations and/or flow fluctuations, and signal processing modules that interpret these measurements.

Down-linking is achieved by either periodically varying the flow-rate of the mud in the system or by periodically varying the rotation rate of the drillstring. In the first case, the flow rate is controlled using a bypass-actuator and controller, and the signal is received in the downhole MWD system using a sensor that is affected by either flow or pressure. In the second case, the surface rotary speed is controlled manually, and the signal is received using a sensor that is affected.

For uplink telemetry, a suitable pulser is described in U.S. Pat. No. 6,626,253 to Hahn et al., having the same assignee as the present application and the contents of which are fully incorporated herein by reference. Described in Hahn '253 is an anti-plugging oscillating shear valve system for generating pressure fluctuations in a flowing drilling fluid. The system includes a stationary stator and an oscillating rotor, both with axial flow passages. The rotor oscillates in close proximity to the stator, at least partially blocking the flow through the stator and generating oscillating pressure pulses. The rotor passes through two zero speed positions during each cycle, facilitating rapid changes in signal phase, frequency, and/or amplitude facilitating enhanced data encoding.

Drilling systems (described below) include mud pumps for conveying drilling fluid into the drillstring and the borehole.

Pressure waves from surface mud pumps produce considerable amounts of noise. The pump noise is the result of the motion of the mud pump pistons. The pressure waves from the mud pumps travel in the opposite direction from the uplink telemetry signal. Components of the noise waves from the surface mud pumps may be present in the frequency range used for transmission of the uplink telemetry signal and may even have a higher level than the received uplink signal, making correct detection of the received uplink signal very difficult. Additional sources of noise include the drilling motor and drill bit interaction with the formation. All these factors degrade the quality of the received uplink signal and make it difficult to recover the transmitted information.

There have been numerous attempts to find solutions for reducing interfering effects in MWD telemetry signals. See, for example, U.S. Pat. Nos. 3,747,059 and 3,716,830 to Garcia, U.S. Pat. No. 3,742,443 to Foster et al, U.S. Pat. No. 4,262,343 to Claycomb, U.S. Pat. No. 4,590,593 to Rodney, U.S. Pat. No. 4,642,800 to Umeda, U.S. Pat. No. 5,146,433 to Kosmala et al, U.S. Pat. No. 4,715,022 to Yeo, U.S. Pat. No. 4,692,911 to Scherbatskoy, U.S. Pat. No. 5,969,638 to Chin, GB 2361789 to Tennent et al., and U.S. patent application Ser. No. 11/311,196 of Reckmann et al. These are examples of what are called "passive" systems in which measurements are made at or near the surface of the borehole to estimate and cancel pump noise and other surface sources of noise. Such passive methods cannot distinguish between the uplink telemetry signal and drilling-generated noise in the mud channel.

The present disclosure is a method and apparatus for active cancellation of noise, such as drilling noise, that is generated downhole.

SUMMARY OF THE DISCLOSURE

One embodiment of the disclosure is a method of communicating a telemetry signal from a downhole location to an uphole location during drilling operations. The method includes measuring a first signal indicative of a drilling noise at the location near the source of the noise in a communication channel in the borehole. The telemetry signal and the first signal are used to activate a pulser and provide an uplink signal at the downhole location. A second signal is received at the uphole location indicative of the uplink signal, and the second signal is processed for estimating the telemetry signal. The first signal may be a pressure signal or a flow rate signal. Providing the uplink signal may further include measuring a third signal responsive to the uplink signal at a location near the downhole location, filtering the first signal using a filter derived from the third signal and the first signal, and combining the telemetry signal and the filtered first signal. The filtering may include applying a time delay and an attenuation factor. The time delay may be estimated by cross correlating the first signal and the third signal. Derivation of the filter may be done by estimating a transfer function of the communication channel between the location proximate to the noise source and a location or the pulser. The source of the drilling noise may be a drill bit and/or a mud motor. Receiving the second signal may be done using a plurality of sensors and estimating the telemetry signal may be done by attenuating a surface noise. The source of the drilling noise may be conveyed on a bottomhole assembly using a drilling tubular.

Another embodiment of the disclosure is a system for communicating a telemetry signal from a downhole location to an uphole location during drilling operations. The system includes a first sensor configured to measure a first signal indicative of the drilling noise at a location near the source thereof in a communication channel in the borehole. The system also includes at least one processor configured to use the telemetry signal and the first signal to activate a pulser and provide and uplink signal at the downhole location, and process a second signal at the uphole location indicative of the uplink signal to estimate the telemetry signal. The first sensor may be configured to be responsive to a pressure signal and/or a flow rate signal. The at least one processor may be further configured to activate the pulser by using a third signal responsive to the uplink signal measured by a sensor at a location near the downhole location, filtering the first signal using a filter derived from the third signal and the first signal, and combining the telemetry signal and the filtered first signal. The at least one processor may be further configured to filter the first signal by applying a time delay and an attenuation factor. The processor may be further configured to determine the time delay by cross-correlating the first signal and the third signal. The processor may be further configured to derive the filter by estimating a transfer function of the communication channel between the location proximate to the noise source and a location of the pulser. The source of the drilling noise may be a drill bit and/or a mud motor. The system may further include a plurality of sensors configured to provide the second signal and wherein the at least one processor is further configured to estimate the telemetry signal by attenuating a surface noise. The system may include a drilling tubular configured to convey the source of drilling noise on a bottomhole assembly.

Another embodiment is a computer-readable medium for use with a system for communicating a telemetry signal from a downhole location to an uphole location during drilling operations. The system includes a first sensor configured to measure a first signal indicative of the drilling noise at a location near the source thereof in a communication channel in the borehole. The medium includes instructions that enable at least one processor to use the telemetry signal and the first signal to activate a pulser and provide an uplink signal at the downhole location, and process a second signal at the uphole location indicative of the uplink signal to estimate the telemetry signal. The medium may include a ROM, an EPROM, an EAROM, a flash memory, and/or an optical disk.

BRIEF DESCRIPTION OF THE DRAWINGS

For a detailed understanding of the present disclosure, reference should be made to the following detailed description of the preferred embodiment, taken in conjunction with the accompanying drawings, in which like elements have been given like numerals and wherein:

FIGS. 2*a*-2*c* (prior art) is a schematic of an oscillating shear valve suitable for use with the present disclosure;

DETAILED DESCRIPTION OF THE DISCLOSURE

Figure 1:
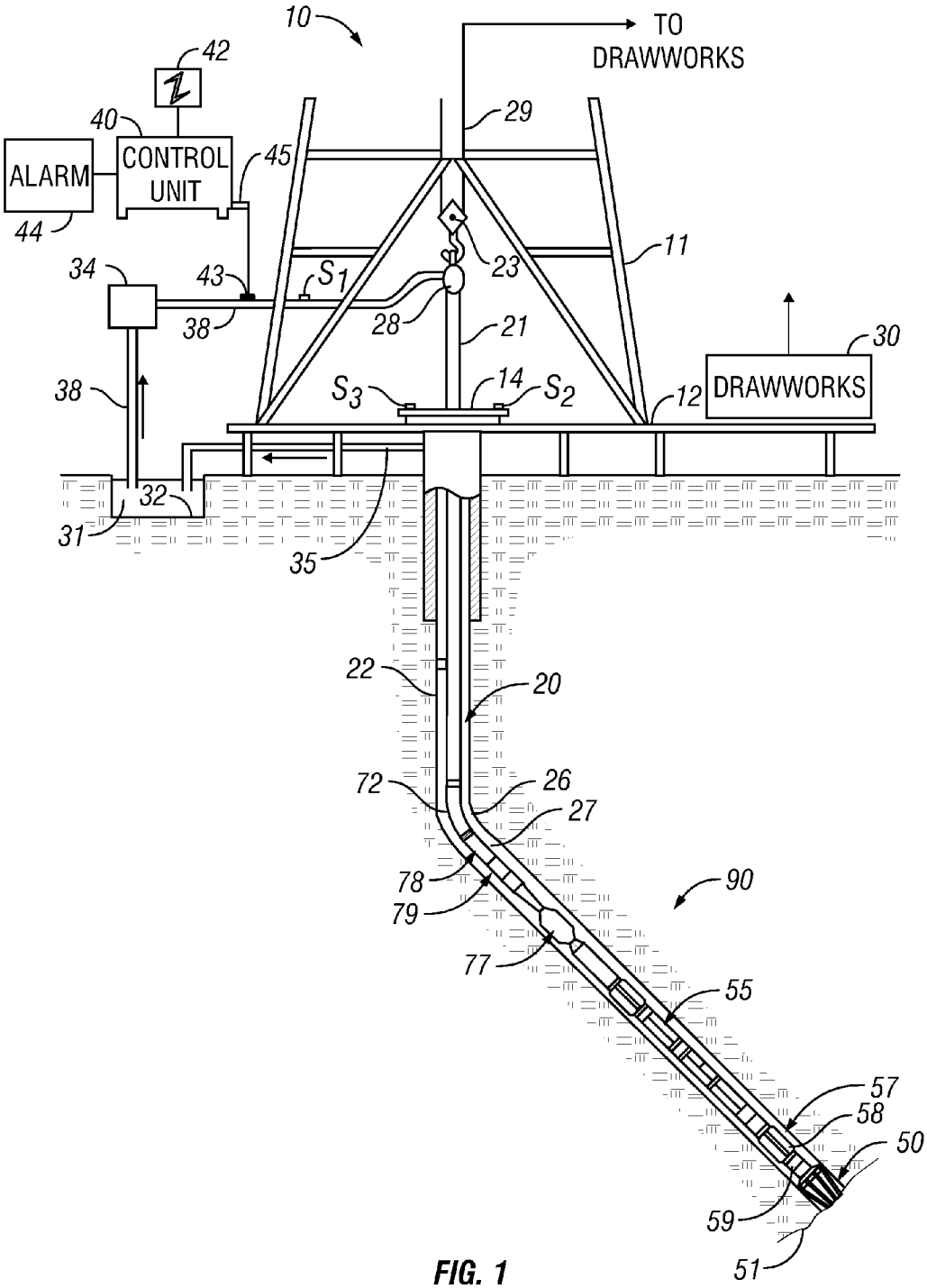
FIG. 1 (Prior Art)
FIG. 1 (prior art) is a schematic illustration of a drilling system suitable for use with the present disclosure.

FIG. 1 shows a schematic diagram of a drilling system 10 with a drillstring 20 carrying a drilling assembly 90 (also referred to as the bottomhole assembly, or "BHA") conveyed in a "wellbore" or "borehole" 26 for drilling the wellbore. The drilling system 10 includes a conventional derrick 11 erected on a floor 12 which supports a rotary table 14 that is rotated by a prime mover such as an electric motor (not shown) at a desired rotational speed. The drillstring 20 includes tubing such as a drill pipe 22 or a coiled-tubing extending downward from the surface into the borehole 26. The drillstring 20 is pushed into the wellbore 26 when a drill pipe 22 is used as the tubing. For coiled-tubing applications, a tubing injector, such as an injector (not shown), however, is used to move the tubing from a source thereof, such as a reel (not shown), to the wellbore 26. The drill bit 50 attached to the end of the drillstring breaks up the geological formations when it is rotated to drill the borehole 26. If a drill pipe 22 is used, the drillstring 20 is coupled to a drawworks 30 via a Kelly joint 21, swivel 28, and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drillstring 20 by a mud pump 34. The drilling fluid passes from the mud pump 34 into the drillstring 20 via a desurger (not shown), fluid line 38 and Kelly joint 21. The drilling fluid 31 is discharged at the borehole bottom 51 through an opening in the drill bit 50. The drilling fluid 31 circulates uphole through the annular space 27 between the drillstring 20 and the borehole 26 and returns to the mud pit 32 via a return line 35. The drilling fluid acts to lubricate the drill bit 50 and to carry borehole cutting or chips away from the drill bit 50. A sensor $S_1$ typically placed in the line 38 provides information about the fluid flow rate. A surface torque sensor $S_2$ and a sensor $S_3$ associated with the drillstring 20 respectively provide information about the torque and rotational speed of the drillstring. Additionally, a sensor (not shown) associated with line 29 is used to provide the hook load of the drillstring 20.

In one embodiment of the disclosure, the drill bit 50 is rotated by only rotating the drill pipe 22. In another embodiment of the disclosure, a downhole motor 55 (mud motor) is disposed in the drilling assembly 90 to rotate the drill bit 50 and the drill pipe 22 is rotated usually to supplement the rotational power, if required, and to effect changes in the drilling direction.

In an exemplary embodiment of FIG. 1, the mud motor 55 is coupled to the drill bit 50 via a drive shaft (not shown) disposed in a bearing assembly 57. The mud motor rotates the drill bit 50 when the drilling fluid 31 passes through the mud motor 55 under pressure. The bearing assembly 57 supports the radial and axial forces of the drill bit. A stabilizer 58 coupled to the bearing assembly 57 acts as a centralizer for the lowermost portion of the mud motor assembly.

In one embodiment of the disclosure, a drilling sensor module 59 is placed near the drill bit 50. The drilling sensor module contains sensors, circuitry and processing software and algorithms relating to the dynamic drilling parameters. Such parameters typically include bit bounce, stick-slip of the drilling assembly, backward rotation, torque, shocks, borehole and annulus pressure, acceleration measurements and other measurements of the drill bit condition. A suitable telemetry or communication sub 72 using, for example, two-way telemetry, is also provided as illustrated in the drilling assembly 90. The drilling sensor module processes the sensor information and transmits it to the surface control unit 40 via the telemetry system 72.

The communication sub 72, a power unit 78 and an MWD tool 79 are all connected in tandem with the drillstring 20. Flex subs, for example, are used in connecting the MWD tool 79 in the drilling assembly 90. Such subs and tools form the bottom hole drilling assembly 90 between the drillstring 20 and the drill bit 50. The drilling assembly 90 makes various measurements including the pulsed nuclear magnetic resonance measurements while the borehole 26 is being drilled. The communication sub 72 obtains the signals and measurements and transfers the signals, using two-way telemetry, for example, to be processed on the surface. Alternatively, the signals can be processed using a downhole processor in the drilling assembly 90.

The surface control unit or processor 40 also receives signals from other downhole sensors and devices and signals from sensors $S_1$-$S_3$ and other sensors used in the system 10 and processes such signals according to programmed instructions provided to the surface control unit 40. The surface control unit 40 displays desired drilling parameters and other information on a display/monitor 42 utilized by an operator to control the drilling operations. The surface control unit 40 typically includes a computer or a microprocessor-based processing system, memory for storing programs or models and data, a recorder for recording data, and other peripherals. The control unit 40 is typically adapted to activate alarms 44 when certain unsafe or undesirable operating conditions occur. The system also includes a downhole processor, sensor assembly for making formation evaluation and an orientation sensor. These may be located at any suitable position on the bottomhole assembly (BHA).

FIG. 2*a* is a schematic view of the pulser, also called an oscillating shear valve, assembly 19, for mud pulse telemetry. The pulser assembly 19 is located in the inner bore of the tool housing 101. The housing 101 may be a bored drill collar in the bottomhole assembly 10, or, alternatively, a separate housing adapted to fit into a drill collar bore. The drilling fluid 31 flows through the stator 102 and rotor 103 and passes through the annulus between the pulser housing 108 and the inner diameter of the tool housing 101.

The stator 102, see FIGS. 2*a* and 2*b*, is fixed with respect to the tool housing 101 and to the pulser housing 108 and has multiple lengthwise flow passages 120. The rotor 103, see FIGS. 2*a* and 2*c*, is disk shaped with notched blades 130 creating flow passages 125 similar in size and shape to the flow passages 120 in the stator 102. Alternatively, the flow passages 120 and 125 may be holes through the stator 102 and the rotor 103, respectively. The rotor passages 125 are adapted such that they can be aligned, at one angular position with the stator passages 120 to create a straight through flow path. The rotor 103 is positioned in close proximity to the stator 102 and is adapted to rotationally oscillate. An angular displacement of the rotor 103 with respect to the stator 102 changes the effective flow area creating pressure fluctuations in the circulated mud column. To achieve one pressure cycle it is necessary to open and close the flow channel by changing the angular positioning of the rotor blades 130 with respect to the stator flow passage 120. This can be done with an oscillating movement of the rotor 103. Rotor blades 130 are rotated in a first direction until the flow area is fully or partly restricted. This creates a pressure increase. They are then rotated in the opposite direction to open the flow path again. This creates a pressure decrease. The required angular displacement depends on the design of the rotor 103 and stator 102. The more flow paths the rotor 103 incorporates, the less the angular displacement required to create a pressure fluctuation is. A small actuation angle to create the pressure drop is desirable. The power required to accelerate the rotor 103 is proportional to the angular displacement. The lower the angular displacement is, the lower the required actuation power to accelerate or decelerate the rotor 103 is. As an example, with eight flow openings on the rotor 103 and on the stator 102, an angular displacement of approximately 22.5° is used to create the pressure drop. This keeps the actuation energy relatively small at high pulse frequencies. Note that it is not necessary to completely block the flow to create a pressure pulse and therefore different amounts of blockage, or angular rotation, create different pulse amplitudes.

The rotor 103 is attached to shaft 106. Shaft 106 passes through a flexible bellows 107 and fits through bearings 109 which fix the shaft in radial and axial location with respect to housing 108. The shaft is connected to a electrical motor 104, which may be a reversible brushless DC motor, a servomotor, or a stepper motor. The motor 104 is electronically controlled, by circuitry in the electronics module 135, to allow the rotor 103 to be precisely driven in either direction. The precise control of the rotor 103 position provides for specific shaping of the generated pressure pulse. Such motors are commercially available and are not discussed further. The electronics module 135 may contain a programmable processor which can be preprogrammed to transmit data utilizing any of a number of encoding schemes which include, but are not limited to, Amplitude Shift Keying (ASK), Frequency Shift Keying (FSK), or Phase Shift Keying (PSK) or the combination of these techniques.

In one embodiment of the disclosure, the tool housing 101 has pressure sensors, not shown, mounted in locations above and below the pulser assembly, with the sensing surface exposed to the fluid in the drill string bore. These sensors are powered by the electronics module 135 and can be for receiving surface transmitted pressure pulses. The processor in the electronics module 135 may be programmed to alter the data encoding parameters based on surface transmitted pulses. The encoding parameters can include type of encoding scheme, baseline pulse amplitude, baseline frequency, or other parameters affecting the encoding of data.

The entire pulser housing 108 is filled with appropriate lubricant 111 to lubricate the bearings 109 and to pressure compensate the internal pulser housing 108 pressure with the downhole pressure of the drilling mud 31. The bearings 109 are typical anti-friction bearings known in the art and are not described further. In one embodiment, the seal 107 is a flexible bellows seal directly coupled to the shaft 106 and the pulser housing 108 and hermetically seals the oil filled pulser housing 108. The angular movement of the shaft 106 causes the flexible material of the bellows seal 107 to twist thereby accommodating the angular motion. The flexible bellows material may be an elastomeric material or, alternatively, a fiber reinforced elastomeric material. It is necessary to keep the angular rotation relatively small so that the bellows material will not be overstressed by the twisting motion. In an alternate preferred embodiment, the seal 107 may be an elastomeric rotating shaft seal or a mechanical face seal.

In one embodiment, the motor 104 is adapted with a double ended shaft or alternatively a hollow shaft. One end of the motor shaft is attached to shaft 106 and the other end of the motor shaft is attached to torsion spring 105. The other end of torsion spring 105 is anchored to end cap 115. The torsion spring 105 along with the shaft 106 and the rotor 103 comprise a mechanical spring-mass system. The torsion spring 105 is designed such that this spring-mass system is at its natural frequency at, or near, the desired oscillating pulse frequency of the pulser. The methodology for designing a resonant torsion spring-mass system is well known in the mechanical arts and is not described here. The advantage of a resonant system is that once the system is at resonance, the motor only has to provide power to overcome external forces and system dampening, while the rotational inertia forces are balanced out by the resonating system.

Figure 3:
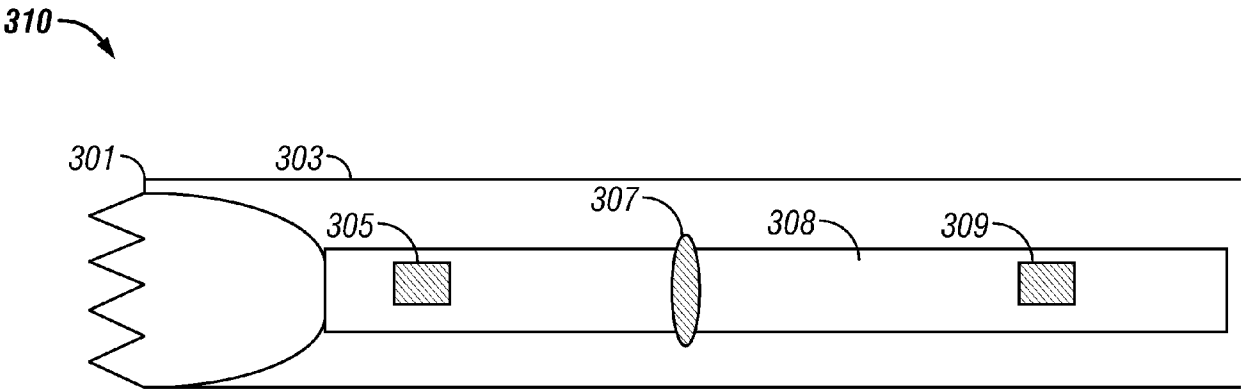
FIG. 3 is an illustration of the configuration of some of the components of the present disclosure.

Turning now to FIG. 3, components of an embodiment of the disclosure are illustrated. Shown therein is a borehole 303 in an earth formation 310. The annulus between the drillstring and the borehole wall serves as a communication channel for telemetry signals. The drillbit is depicted by 301. The drillbit is carried at the end of a hollow shaft 308 that forms part of the BHA. The pulser is depicted by 307. A first pressure sensor 303 is provided near the drillbit. This pressure sensor is responsive to pressure variations in the mud (which may be designated as the first signal). One component of the pressure variation results from relatively low frequency changes caused by changes in the mud flow as part of drilling operations. In addition, the pressure changes would also include a higher frequency component resulting from operation of the drillbit. In normal drilling operations, the pressure variations caused by the drilling action would be additive to the uplink telemetry signal from the pulser 307. Passive systems that rely on measurements of the pressure at or near the surface would be unable to distinguish between the uplink telemetry signal and the drilling noise.

Figure 4:
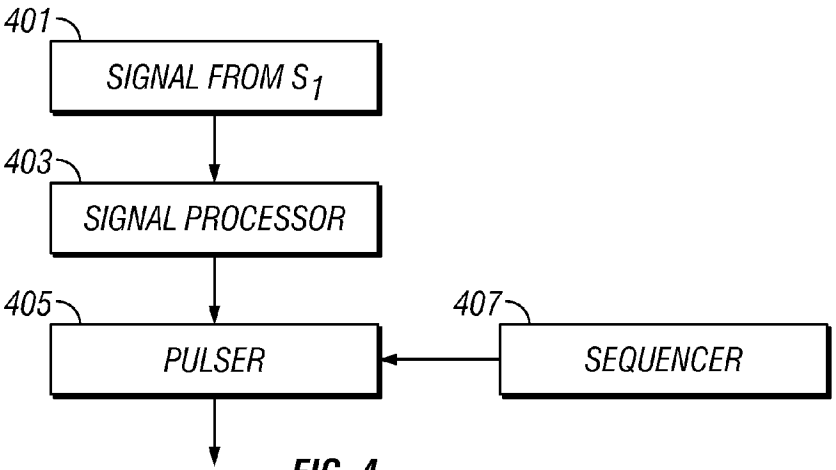
FIG. 4 is a flow chart of one embodiment of the method of the present disclosure using a single sensor.

Turning now to FIG. 4, in one embodiment of the disclosure, the signal 401 from the pressure sensor 305 is input to a signal processor 403. The signal processor 403 uses the measured signal from the first pressure sensor to provide an input to the pulser 404 that compensates for the mud pulse traveling along the drilling column due to the drilling noise. The compensating signal and the coded telemetry signal from the sequencer 407 are input to the pulser. The output of the pulser will then consist substantially of the desired uplink telemetry signal. Various methods for determining the compensating signal are discussed below.

Figure 5:
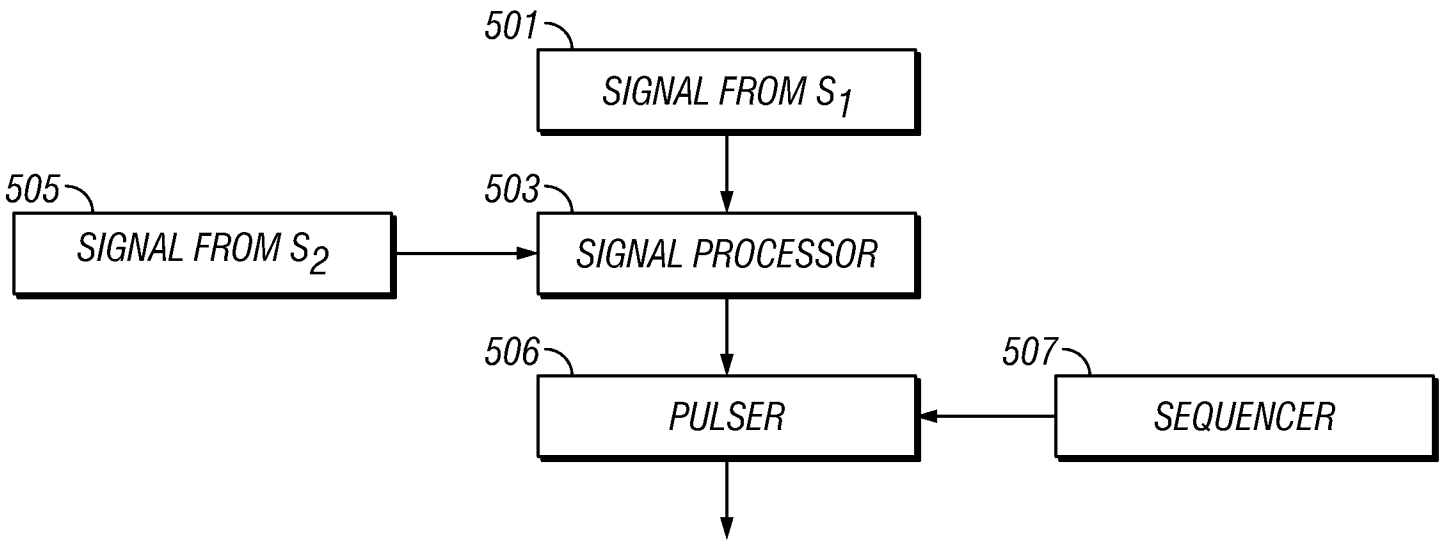
FIG. 5 is a flow chart of another embodiment of the method of the present disclosure using dual sensors.

FIG. 5 shows an alternate arrangement. The signal 501 from the first sensor 305 is input to the signal processor 503. In addition, the signal 505 from a second sensor 309 is also input to the signal processor 503. This may be referred to as the third signal. The second pressure sensor is positioned above the pulser. The signal processor then provides a compensating signal to the pulser 506 based on the signals 501, 505 from the two sensors 305, 309. The output of the pulser is then a combination of the telemetry signal from the sequencer 507 and the compensating signal from the processor 503. By suitable design of the compensating signal, pressure variations in the mud column due to drilling are attenuated.

Figure 6:
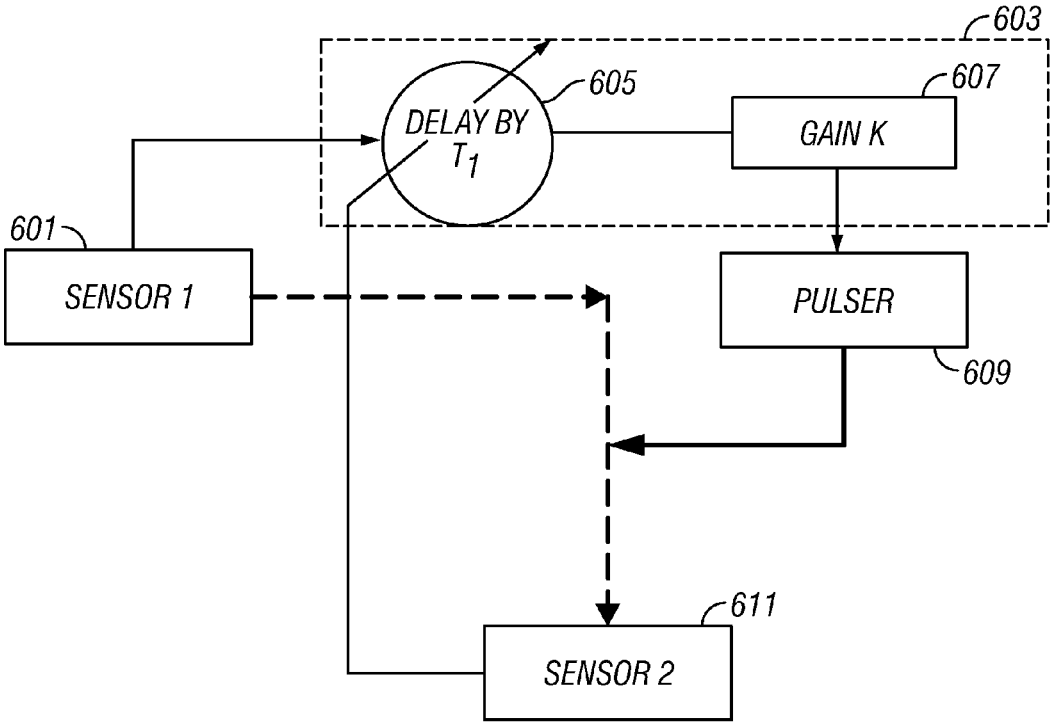
FIG. 6 illustrates the feedback used by the processor in the embodiment of the disclosure shown in FIG. 5.

The derivation of the compensating signal is discussed next. Shown in FIG. 6 is the basic configuration of the two sensors 305, 309. The thick broken lines indicate signals within the mud channel. In one embodiment of the disclosure, the system illustrated in FIG. 5 is first operated without a telemetry signal but with continued drilling. Internal to the processor 403 are shown two exemplary parameters that may be adjusted. One of them is the delay time T that is applied by the pulser to the output of the first sensor. A second parameter is the relative gain to be applied to the compensating signal. When there is no telemetry signal, and if the compensating signal is correct, then the second sensor should have zero output, i.e., the pulser 405 has correctly compensated for the mud pulse traveling along the mud column that was generated by the drillbit. However, if the second sensor 309 does measure a signal when there is no telemetry signal, the processor alters the time delay 605 and/or the relative gain 607 of the compensating signal so as to minimize, e.g., in a least squares sense, the measured signal at the second sensor. Those versed in the art would recognize that the compensating signal should be of opposite polarity to the signal detected by the first sensor.

In addition to adjusting the delay and the gain factor, the processor may perform additional operations in providing the compensating signal. For example, the compensating signal may be band-limited to correspond to the bandwidth that is to be used for telemetry signals.

In addition, in one embodiment of the disclosure, measurements are made with the first sensor and the second sensor with the pulser inoperative. Under these conditions, a correlation between the signals at the two sensors gives a direct measure of the travel-time for a mud pulse between the two sensors while the drillbit is operating. The estimated time delay may then be interpolated to give the time delay between the first sensor and the pulser. Thus, if $s_1(t)$ and $s_2(t)$ are the signals at the two sensors, the cross-correlation between the two signals is given by:

$$R_{s1,s2}(T) = \int_{Tw/2}^{-Tw/2} s_1(\tau)s_2(\tau - T)d\tau, \tag{1}$$

Where $T_w$ is a time window over which the correlation is determined. The time delay for which $R_{s1,s2}(T)$ attains a maximum is an estimate of the time or propagation of a mud pulse from the first sensor to the second sensor. This determined value is interpolated to give a delay time between the first sensor and the pulser. It should be noted that this estimated time delay may need to be adjusted for electromechanical delays in the pulser. As would be known to those versed in the art, a low cut filter should be applied prior to determination of the autocorrelation.

The attenuation of a mud pulse traveling between the first sensor and the second sensor may be determined by measuring the power of the signals $S_1$ and $S_2$ over a window length. The attenuation may then be interpolated to give an estimated attenuation of a mud pulse between the first sensor and the pulser.

Figure 7:
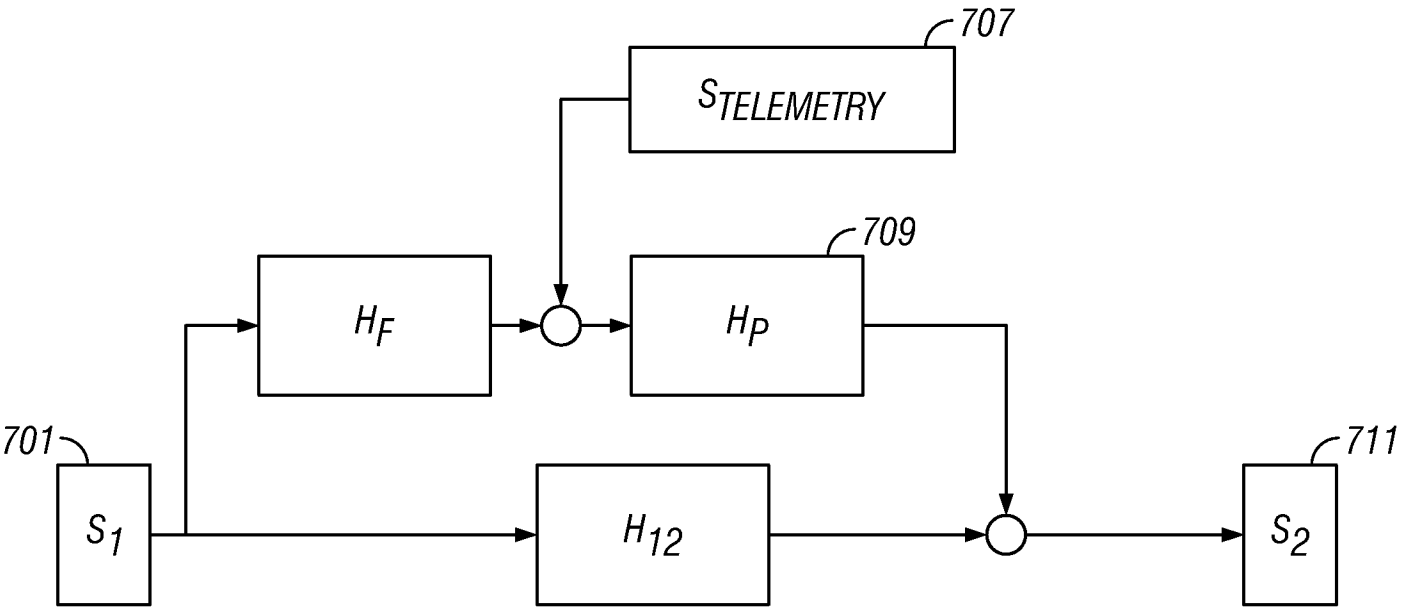
FIG. 7 illustrates a method of determining a transfer function of the mud channel between the drillbit and the pulser.

When the second sensor is positioned close to the pulser, it is possible to estimate the transfer function of the mud channel between the sensor $s_1$ and the pulser. This is illustrated in FIG. 7. Shown therein are the two sensors 701, 711, the telemetry encoder 709 and the pulser 709. In the absence of a telemetry signal, $$H_{12} = \frac{F(s_1)}{F(s_2)},$$

where F(.) denotes the Fourier transform of a signal and $H_{12}$ is the transfer function. The transfer function of the pulser $H_f$ is a known (or determinable) quantity. Hence the filter to be applied to the output of $s_1$ may be given by $$H_F = -\frac{H_{12}}{H_P}.$$

Those versed in the art and having benefit of the present disclosure would recognize that the method and apparatus of the present disclosure could also be used to attenuate noise in the mud channel caused by using a mud motor. For the purposes of the disclosure, noise generated by the mud motor may also be included in the term "drilling noise". This may be accomplished by positioning the first sensor above the mud motor, the pulser above the first pressure sensor and the second pressure sensor above the pulser.

Once noise in the mud channel due to drilling noise has been attenuated, it is then possible to use prior art methods for attenuating noise due to surface sources such as mud pumps. An example of such a method is described in the Reckmann application, having the same assignee as the present disclosure and the contents of which are incorporated herein by reference. As taught therein, measurements made with dual sensors (flow rate or pressure) are used to attenuate pump noise in a signal at a surface location, referred to as the second signal, responsive to the uplink signal in a mud pulse telemetry system The operation of the transmitter and receivers may be controlled by the downhole processor and/or the surface processor. Implicit in the control and processing of the data is the use of a computer program on a suitable machine readable medium that enables the processor to perform the control and processing. The machine readable medium may include ROMs, EPROMs, EAROMs, Flash Memories and Optical disks. The results of the processing may be output to a suitable medium for display or for use in subsequent operations related to reservoir development. These additional operations may include design of completion strings, positioning of additional boreholes and operations of flow control devices.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. A method of communicating a telemetry signal from a downhole location to an uphole location during drilling operations, the method comprising:

measuring a first signal indicative of a drilling noise at a location near the source of the noise in a communication channel in the borehole;

using the telemetry signal and the first signal to activate a pulser and provide an uplink signal at the downhole location in the borehole such that effects of the drilling noise on the uplink signal are mitigated receiving a second signal at the uphole location responsive to the uplink signal; and processing the second signal for estimating the telemetry signal wherein providing the uplink signal further comprises:

(i) measuring a third signal responsive to the uplink signal at a location near the downhole location and between the downhole location and the uphole location;

(ii) filtering the first signal using a filter derived from the third signal and the first signal; and (iii) combining the telemetry signal and the filtered first signal;

and wherein the filter is further derived from sampling, prior to measuring the first signal, a signal at the location near the source of the noise during a training period when there is drilling noise and no telemetry signal.

2. The method of claim 1 wherein the first signal is selected from the group consisting of (i) a pressure signal, and (ii) a flow rate signal.

3. The method of claim 1 wherein the filtering further comprises applying a time delay and an attenuation factor.

4. The method of claim 3 further comprising determining the time delay by cross-correlating the first signal and the third signal.

5. The method of claim 1 wherein deriving the filter further comprises estimating a transfer function of the communication channel between the location proximate to the noise source and a location of the pulser.

6. The method of claim 1 wherein the source of drilling noise is selected from the group consisting of: (i) a drillbit, and (ii) a mud motor.

7. The method of claim 1 wherein receiving the second signal further comprises using a plurality of sensors and estimating the telemetry signal further comprises attenuating a surface noise.

8. The method of claim 1 further comprising conveying the source of drilling noise on a bottomhole assembly using a drilling tubular.

9. The method of claim 1 wherein providing the uplink signal is carried out using a compensating signal corresponding to the bandwidth of the telemetry signal.

10. A system for communicating a telemetry signal from a downhole location to an uphole location during drilling operations, the system comprising:

(a) a first sensor configured to measure a first signal indicative of the drilling noise at a location near the source thereof in a communication channel in the borehole;

(b) at least one processor configured to:

(A) use the telemetry signal and the first signal to activate a pulser and provide an uplink signal at the downhole location in the borehole such that effects of the drilling noise on the uplink signal are mitigated; and (B) process a second signal at the uphole location responsive to the uplink signal to estimate the telemetry signal; and (c) a second sensor at a location near the downhole location and between the downhole location and the uphole location, the second sensor configured to measure a third signal in the communication channel in the borehole;

wherein the at least one processor is further configured to activate the pulser by:

(i) measuring the third signal responsive to the uplink signal with the second sensor;

(ii) filtering the first signal using a filter derived from the third signal and the first signal; and (iii) combining the telemetry signal and the filtered first signal; and wherein the at least one processor is further configured to derive the filter from sampling, prior to measuring the first signal, a signal at the location near the source of the noise during a training period when there is drilling noise and no telemetry signal.

11. The system of claim 10 wherein the first sensor is configured to be responsive to one of: (i) a pressure signal, and (ii) a flow rate signal.

12. The system of claim 10 wherein the at least one processor is further configured to filter the first signal by applying a time delay and an attenuation factor.

13. The system of claim 12 wherein the at least one processor is further configured to determine the time delay by cross-correlating the first signal and the third signal.

14. The system of claim 10 wherein the at least one processor is further configured to derive the filter by estimating a transfer function of the communication channel between the location proximate to the noise source and a location of the pulser.

15. The system of claim 10 wherein the source of drilling noise is selected from the group consisting of: (i) a drillbit, and (ii) a mud motor.

16. The system of claim 10 further comprising a plurality of sensors configured to provide the second signal and wherein the at least one processor is further configured to estimate the telemetry signal by attenuating a surface noise.

17. The system of claim 10 further comprising a drilling tubular configured to convey the source of drilling noise on a bottomhole assembly.

18. The system of claim 10 wherein the second sensor is positioned for estimation of the transfer function of the mud channel between the first sensor and the pulser.

19. A non-transitory computer-readable medium product having thereon instructions that when read by at least one processor cause the at least one processor to execute a method, the method comprising:

communicating a telemetry signal and a first signal indicative of a drilling noise at a downhole location in a borehole to activate a pulser and providing an uplink signal at the downhole location such that effects of the drilling noise on the uplink signal are mitigated; and processing a second signal at an uphole location responsive to the uplink signal for estimating the telemetry signal wherein providing the uplink signal further comprises:

(i) measuring a third signal responsive to the uplink signal at a location near the downhole location and between the downhole location and the uphole location;

(ii) filtering the first signal using a filter derived from the third signal and the first signal; and (iii) combining the telemetry signal and the filtered first signal;

and wherein the filter is further derived from sampling, prior to measuring the first signal, a signal at the location near the source of the noise during a training period when there is drilling noise and no telemetry signal.

20. The non-transitory computer-readable medium product of claim 19 further comprising at least one of: (i) a ROM, (ii) an EPROM, (iii) an EAROM, (iv) a flash memory, and (v) an optical disk.

* * * * *